US007946827B2

(12) United States Patent
Beckford

(10) Patent No.: US 7,946,827 B2
(45) Date of Patent: May 24, 2011

(54) BLADES

(75) Inventor: Peter R. Beckford, Derby (GB)

(73) Assignee: Rolls-Royce PLC, London (GB)

( * ) Notice: Subject to any disclaimer, the term of this patent is extended or adjusted under 35 U.S.C. 154(b) by 1016 days.

(21) Appl. No.: 11/808,546

(22) Filed: Jun. 11, 2007

(65) Prior Publication Data

US 2008/0101960 A1 May 1, 2008

(30) Foreign Application Priority Data

Jul. 6, 2006 (GB) ..... 0613441.5

(51) Int. Cl.
*F04D 29/38* (2006.01)

(52) U.S. Cl. ..... 416/239; 416/243

(58) Field of Classification Search ..... 416/229 A, 416/232, 239, 243
See application file for complete search history.

(56) References Cited

U.S. PATENT DOCUMENTS 5,490,764 A * 2/1996 Schilling ..... 416/239
2003/0021686 A1 1/2003 Anding et al.

FOREIGN PATENT DOCUMENTS

GB 1 567 968 A 5/1980
GB 2 327 467 A 1/1999

* cited by examiner

*Primary Examiner* — Edward Look
*Assistant Examiner* — Dwayne J White
(74) *Attorney, Agent, or Firm* — Oliff & Berridge, PLC

(57) ABSTRACT

A blade for a gas turbine engine includes a root portion, an aerofoil portion and a transition portion between the root portion and the aerofoil portion. The aerofoil portion and the transition portion are defined by first and second wall members, the first and second wall members being secured together in the transition portion and each having an outer surface. The outer surface of at least one of the first and second wall members is generally concave in the transition portion in a radial direction of the blade.

8 Claims, 2 Drawing Sheets

BLADES

Embodiments of the present invention relate to a blade, and in particular to a fan blade for a gas turbine engine.

A fan of a gas turbine engine comprises a fan rotor and a number of circumferentially spaced radially outwardly extending fan blades secured to the fan rotor. The fan is surrounded by a fan casing, which defines a fan duct, and the fan casing is arranged to contain one or more of the fan blades in the unlikely event that a fan blade becomes detached from the fan rotor.

If a fan blade becomes detached from the fan rotor, for example due to impact with a large foreign body such as a bird, the detached fan blade strikes a main fan casing containment region and generally progressively breaks up under a buckling action. Fan blades conventionally increase in strength from the tip to the root and at some position between the tip and the root the remaining portion of the fan blade, including the root, no longer buckles. The remaining portion of the fan blade has substantial mass and is accelerated by the trailing blade until it impacts a rear fan containment region of the fan casing.

It is necessary to provide additional material to the rear fan containment region of the fan casing to contain the remaining portion of a detached fan blade. The additional material may be in the form of an increase in thickness, the provision of ribs, honeycomb liners etc, the impact energy being dissipated by plastic deformation of the additional material. However, these methods of protecting the rear fan containment region are disadvantageous as they add weight to the gas turbine engine.

It would therefore be desirable to provide an improved blade which reduces the need to provide additional material to the rear fan containment region to contain detached blades.

According to a first aspect of the present invention, there is provided a blade for a gas turbine engine, the blade including a root portion, an aerofoil portion and a transition portion between the root portion and the aerofoil portion, the aerofoil portion and the transition portion being defined by first and second wall members, the first and second wall members being secured together in the transition portion and each having an outer surface, wherein the outer surface of at least one of the first and second wall members is generally concave in the transition portion in a radial direction of the blade.

According to a second aspect of the present invention, there is provided a blade for a gas turbine engine, the blade including a root portion, an aerofoil portion and a transition portion between the root portion and the aerofoil portion, the aerofoil portion and the transition portion being defined by first and second wall members each having an outer surface, wherein the distance between the outer surfaces of the first and second wall members is lower in the transition portion than in the aerofoil portion.

The first and second wall members may be spaced apart in the aerofoil portion to define a cavity therebetween.

The blade may define a radially extending neutral axis between the first and second wall members, and the first and second wall members may be joined together along the neutral axis in the transition portion. Alternatively, the first and second wall members may be joined together along a radially extending axis parallel to and offset from the neutral axis. The first and second wall members may be joined in the transition portion by diffusion bonding.

The thickness of each the first and second wall members may be substantially constant throughout the aerofoil portion and the transition portion. Alternatively, the thickness of one or both of the first and second wall members may be greater in the transition portion than in the aerofoil portion.

The outer surface of one or both of the first and second wall members may each define a generally concave recess in the transition portion. At least one of the recesses, and possibly both of the recesses, may include a cellular material. The cellular material may have a honeycomb structure. The cellular material may comprise a metal, and may comprise a metal foam. The metal foam may be a nickel foam, a nickel alloy foam, a titanium foam, a titanium alloy foam, an aluminium foam, an aluminium alloy foam, a magnesium alloy foam or a steel foam.

The blade may include a membrane which may overlie the cellular material. The membrane may be substantially coplanar with the outer surface of the adjacent first or second wall member in the aerofoil portion and may merge with the outer surface of the adjacent first or second wall member.

The first wall member may be a concave wall member and the second wall member may be a convex wall member.

According to a third aspect of the present invention, there is provided a gas turbine engine including a blade according to the first or second aspects of the present invention.

An embodiment of the present invention will now be described by way of example only and with reference to the accompanying drawings, in which:—

Figure 1:
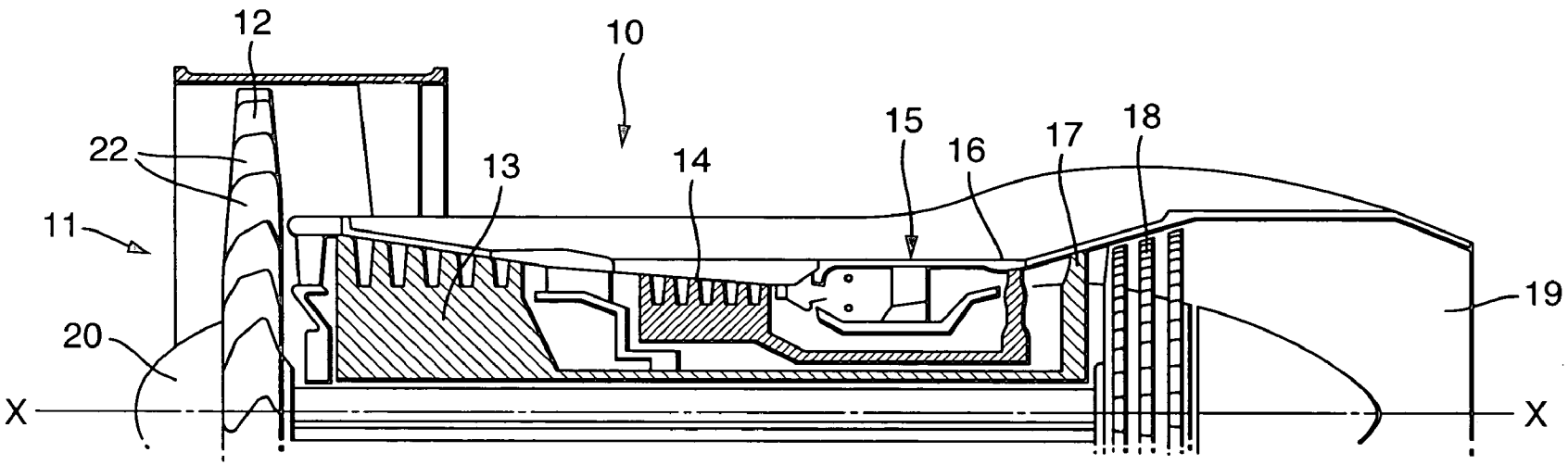
FIG. 1 is a diagrammatic cross-sectional view of a gas turbine engine incorporating a blade according to the present invention.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

Figure 2:
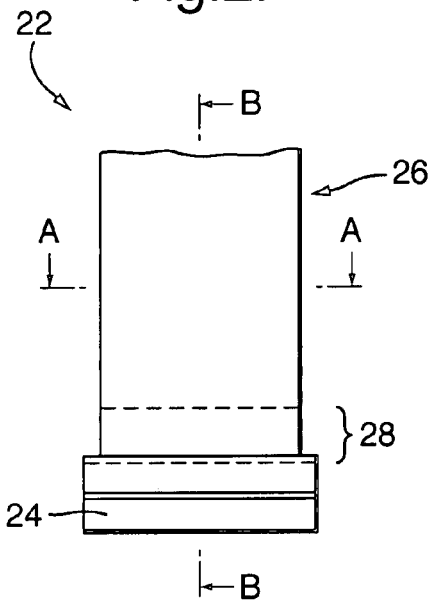
FIG. 2 is an enlarged view of a blade according to the present invention.
Figure 3:
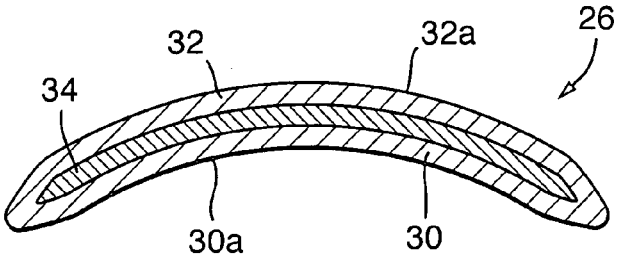
FIG. 3 is a sectional view along the line A-A of FIG. 2.

The propulsive fan 12 comprises a fan rotor 20 carrying a plurality of equi-angularly spaced radially outwardly extending fan blades 22. In more detail, and referring to FIGS. 2 to 4, each blade 22 comprises a root portion 24, a radially extending aerofoil portion 26 and a transition portion 28 between the root portion 24 and the aerofoil portion 26. The aerofoil portion 26 and the transition portion 28 are defined by a first, generally concave, wall member 30 and a second, generally convex, wall member 32. The root portion 24 comprises a dovetail root, a firtree root, or other suitably shaped root for fitting in a correspondingly shaped slot in the fan rotor 20.

As indicated above, each fan blade 22 is designed to progressively break up under a buckling action in the event of detachment from the fan rotor 20. Due to the fact that fan blades conventionally increase in strength from the tip of the aerofoil portion 26 towards the root portion 24, there comes a point when the fan blade 20 no longer buckles and the remaining portion of the fan blade 20, which includes the root portion 24 and the transition portion 28, impacts the fan containment region of the fan casing.

Figure 4:
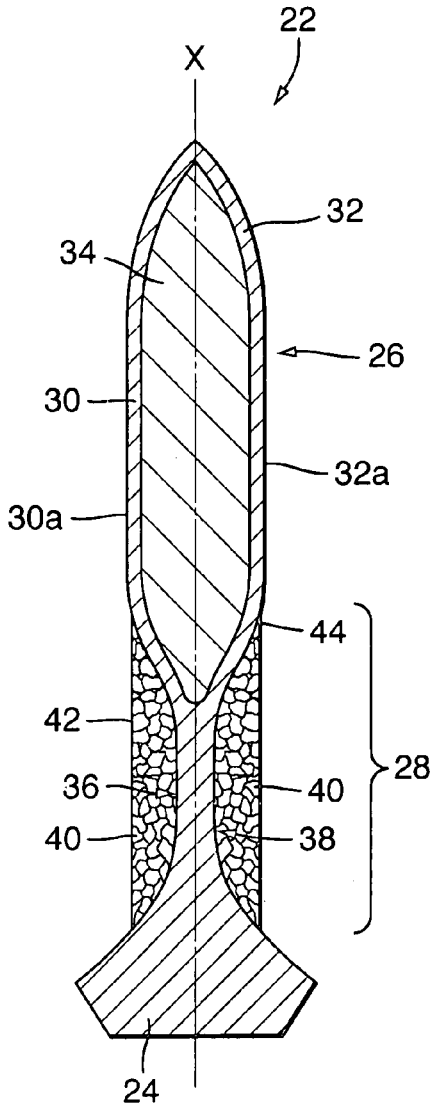
FIG. 4 is a sectional view along the line B-B of FIG. 2.

In embodiments of the invention, as best seen in FIG. 4, the outer surface 30*a*, 32*a* of at least one, and in the illustrated embodiment both, of the concave and convex wall members 30, 32 is generally concave in the transition portion 28 in a radial direction of the blade 22. The thickness of the transition portion 28 is thus reduced relative to existing blades and consequently has a much lower mass and stiffness, thereby reducing the impact forces when a remaining portion of a detached fan blade impacts the fan containment region of a fan casing.

In the embodiment shown in FIG. 4, the distance between the outer surfaces 30*a*, 32*a* of the concave and convex wall members 30, 32 is lower in the transition portion 28 than in the aerofoil portion 26. This may not, however, be the case with all blades 22.

To form the aerofoil portion 26, the peripheral edges of substantially planar panels are secured together by diffusion bonding and these are then superplastically deformed to provide the concave and convex wall members 30, 32 and to define a cavity 34 between the concave and convex wall members 30, 32. As is known in the art, reinforcing means are located in the cavity 34 and, as a result, the blade 22 has a relatively low mass and a very high bending stiffness in the aerofoil portion 26.

Referring to FIG. 4, the cavity 34 terminates at the radially inner end of the aerofoil portion 26 and does not extend significantly into the transition portion 28 where the concave and convex wall members 30, 32 are secured together along a generally radial axis XX, known as the neutral axis, of the blade 22.

In order to provide one or both of the concave and convex wall members 30, 32 with a concave form in the radial direction of the blade 22 and thereby provide the reduction in mass and stiffness in the transition portion 28, material is removed from the concave and convex wall members 30, 32 in the transition portion 28 by a suitable machining process. The mass and bending stiffness of the blade 22 is thus significantly lower in the transition portion 28 than in the transition portion of existing blades.

Embodiments of the invention therefore provide the advantage that when the remaining portion, including the transition portion 28, of a detached blade 22 impacts the fan containment region of the fan casing, the transition portion 28 more readily flexes and deforms, thereby dissipating energy and reducing the impact forces. This deformation increases the impact surface area between the transition portion 28 and the fan containment region of the fan casing thereby facilitating said dissipation of energy and reduction of the impact forces. The mass of the blade 22 in the transition portion 28 is also significantly reduced relative to existing blades, and this further reduces the impact forces with the fan containment region of the fan casing in the event of blade detachment.

As can be seen in FIG. 4, the concave and convex wall members 30, 32 are each formed, for example by a suitable machining process as discussed above, so that their respective outer surfaces 30*a*, 32*a* each define a substantially concave recess 36, 38 in the transition portion 28, each of the recesses 36, 38 extending in the radial direction of the blade 22 between the root portion 24 and the aerofoil portion 26.

In embodiments of the invention, the recesses 36, 38 are filled with a cellular material 40 which may be in the form of a metal foam, for example a nickel foam, a nickel alloy foam, a titanium foam, a titanium alloy foam, an aluminium foam, an aluminium alloy foam a magnesium alloy foam or a steel foam.

The cellular material 40 provides the blade 22 with a desired aerodynamic profile above an annulus line, in which the blade 22 is in the gas flow path, and with a suitable surface, below the annulus line, for annulus filler seals to bear against.

The cellular material 40 advantageously also provides for further dissipation of energy and reduction of the impact forces upon impact of a detached blade with the blade containment region of the fan casing. The cellular material 40 effectively cushions the impact between the transition portion 28 and the fan containment region and readily deforms to provide said further dissipation of energy and reduction of the impact forces.

If desired, a membrane 42, 44 can be provided to overlie the cellular material 40 and, as can be seen in FIG. 4, this is substantially coplanar with the outer surfaces 30*a*, 32*a* of the adjacent concave and convex wall members 30, 32 in the aerofoil portion 26 and merges with the adjacent outer surfaces 30*a*, 32*a*. The provision of such a membrane 42, 44 may improve the aerodynamic properties of the blade 22 under some circumstances and/or improve sealing with the annulus filler seals.

As will be understood by those skilled in the art, by providing improved dissipation of energy upon impact with the fan containment region and by providing a reduction in the impact forces, the use of the blade 22 reduces the need to provide additional material to the fan containment region to contain detached fan blades.

Although embodiments of the invention have been described in the preceding paragraphs with reference to various examples, it should be appreciated that various modifications to the examples given may be made without departing from the scope of the present invention, as claimed.

For example, the cellular material 40 may be omitted from the recesses 36, 38 or alternatively only one of the recesses 36, 38 may be filled with cellular material 40. One or both of the membranes 42, 44 may be omitted.

The cellular material 40 may be any suitable material and is not limited to a metal foam. The cellular material may have a honeycomb structure.

The cavity 34 may extend partially into the transition portion 28.

I claim:

1. A blade for a gas turbine engine, the blade including a root portion, an aerofoil portion and a transition portion between the root portion and the aerofoil portion, the aerofoil portion and the transition portion being defined by first and second wall members, the first and second wall members being secured together in the transition portion and each having an outer surface, wherein the outer surface of at least one of the first and second wall members defines a generally concave recess in the transition portion in a radial direction of the blade, each recess including a cellular material.

2. A blade according to claim 1, wherein the first and second wall members are spaced apart in the aerofoil portion to define a cavity therebetween.

3. A blade according to claim 1, wherein the blade defines a radially extending neutral axis between the first and second wall members, and the first and second wall members are secured together along the neutral axis in the transition portion.

4. A blade according to claim 1, wherein the cellular material is a metal foam.

5. A blade according to claim 1, wherein the blade includes a membrane overlying the cellular material.

6. A blade according to claim 5, wherein the membrane is substantially coplanar with the outer surface of the adjacent first or second wall member in the aerofoil portion.

7. A blade according to claim 1, wherein the first wall member is a concave wall member and the second wall member is a convex wall member.

8. A gas turbine engine including a blade as defined in claim 1.

* * * * *